US005488767A

United States Patent [19]

Franovick

[11] Patent Number: 5,488,767

[45] Date of Patent: Feb. 6, 1996

[54] AUTOMATIC GROMMETING MACHINE

[75] Inventor: Branko Franovick, Pompano Beach, Fla.

[73] Assignee: Stimpson Co., Inc., Pompano Beach, Fla.

[21] Appl. No.: 258,439

[22] Filed: Jun. 10, 1994

[51] Int. Cl.[6] ..... B23P 21/00

[52] U.S. Cl. ..... 29/786; 29/788; 29/798; 29/818; 29/243.518; 227/68; 227/139

[58] Field of Search ..... 29/771, 786, 787, 29/788, 790, 798, 809, 818, 243.5, 243.517, 243.518, 243.519, 243.529, 281.5, 283.5; 227/15, 16, 17, 18, 68, 135, 139, 149, 156

[56] References Cited

U.S. PATENT DOCUMENTS

| | | | |
|---|---|---|---|
| 1,373,500 | 4/1921 | Glass | 227/18 |
| 2,717,714 | 11/1953 | Haley . | |
| 3,326,414 | 6/1965 | Schmidt . | |
| 3,358,895 | 12/1967 | Chiabrandy . | |
| 4,247,032 | 1/1981 | Stanick . | |
| 4,586,641 | 5/1986 | Oura . | |
| 4,703,882 | 11/1987 | Herten . | |
| 4,765,177 | 8/1988 | Pendleton . | |
| 4,768,276 | 9/1988 | Harlow . | |
| 5,014,895 | 5/1991 | Kazuyoshi . | |
| 5,052,096 | 10/1991 | Fuller et al. . | |
| 5,072,505 | 12/1991 | Liechty . | |
| 5,090,115 | 2/1992 | Fuller et al. . | |
| 5,203,051 | 4/1993 | Tonami et al. . | |

FOREIGN PATENT DOCUMENTS

| | | | |
|---|---|---|---|
| 46243 | 4/1936 | France | 227/135 |
| 395411 | 5/1924 | Germany | 227/15 |
| 397508 | 7/1924 | Germany | 227/18 |
| 682087 | 11/1952 | United Kingdom | 227/139 |

*Primary Examiner*—David P. Bryant
*Attorney, Agent, or Firm*—Malin, Haley DiMaggio & Crosby

[57] ABSTRACT

An automatic grommeting machine for high speed, large volume insertion and setting of eyelets, grommets, etc., and their mating washers, without requiring pre-punching of a hole. Dual cams are connected to a series of linkages which control the movement of a top set, a bottom set and a clamper, as well as controlling the withdrawal and insertion of grommet and washer roadway slides in synchrony with the top and bottom sets. The grommeting machine is fully automatic, i.e., the operator simply inserts a piece of material into the machine and activates the machine by pressing a single pedal to insert and set a grommet or eyelet and its corresponding washer in the material.

12 Claims, 9 Drawing Sheets

AUTOMATIC GROMMETING MACHINE

BACKGROUND OF THE INVENTION

1. Field of the Invention

The present invention relates to an automatic grommeting machine for high speed, large volume insertion and setting of eyelets, grommets, etc., and their mating washers, without requiring pre-punching of a hole.

2. Description of the Background Art

Some conventional grommeting machines require the operator to manually insert the grommet or eyelet and mating washer in position before they are set by the grommeting machine. Thus, the operator must perform at least three steps, i.e, inserting a grommet or eyelet, inserting the mating washer, and placing the material in the machine, prior to setting the pieces. This process is both time consuming and inefficient. Other conventional machines also require the operator to cut or punch a hole in the material prior to setting the grommet or eyelet and mating washer. The above described grommeting machines are particularly unsuited and inefficient for factories where high speed and high volume grommet or eyelet insertion procedures are required. Further, conventional hole cutting or punching processes remove small amounts of the material which could be used more effectively, e.g., to strengthen the set, when sandwiched between the grommet and washer.

Some conventional grommeting machines employ a dual feed apparatus, such as disclosed in Stanik (U.S. Pat. No. 4,247,032). However, these machines typically require a retracting mechanism for physically moving the entire grommet and/or washer feeding structures out of the way of the piercing and setting apparatus when the grommet and/or washer are inserted and set. The retracting mechanism must move out of the way rapidly so that the grommet and washer can be inserted and set quickly without interference from the setting and inserting apparatus, yet the retracting mechanism is often cumbersome and heavy. As a result, when the retracting mechanism moves the relatively heavy grommet and/or washer feeding structures out of the way of the setting apparatus, the grommeting machine vibrates excessively, sometimes causing the grommeting machine to "walk" across the floor if the machine is not secured.

SUMMARY OF THE INVENTION

It is an object of the invention to provide a grommeting machine for automatically inserting and setting grommets or eyelets and their mating washers.

It is another object to provide a grommeting machine which cuts or pierces the material automatically with the grommet insertion and setting procedures.

It is still another object to provide a one-step, automatic grommeting machine for increased production and efficiency.

It is another object to provide a grommeting machine which does not vibrate excessively when the grommets or eyelets and their mating washers are inserted and set.

These and other objects are achieved according to the present invention which comprises a dual cam mechanism for inserting and setting the material. Grommets or eyelets and washers are fed by a roadway or track to the material. The dual cam mechanism operates a series of levers that work together to retract an end portion of the grommet and washer delivery roadways after a grommet or eyelet and the mating washer have been inserted, pierce the material and, finally, set the grommet and washer with the grommeted material sandwiched therebetween. The dual cam mechanism and the levers are configured so that the insertion, piercing, roadway retraction and setting procedures are carried out in synchrony and with maximum efficiency and speed. The resulting machine is fully automatic, i.e., the operator simply inserts the material into the machine and activates the machine to both insert and set the grommet or eyelet and its mating washer.

BRIEF DESCRIPTION OF THE DRAWINGS

The instant invention is described in more detail below and in the accompanying drawings, in which.

DETAILED DESCRIPTION OF THE PREFERRED EMBODIMENTS

Figure 1A:
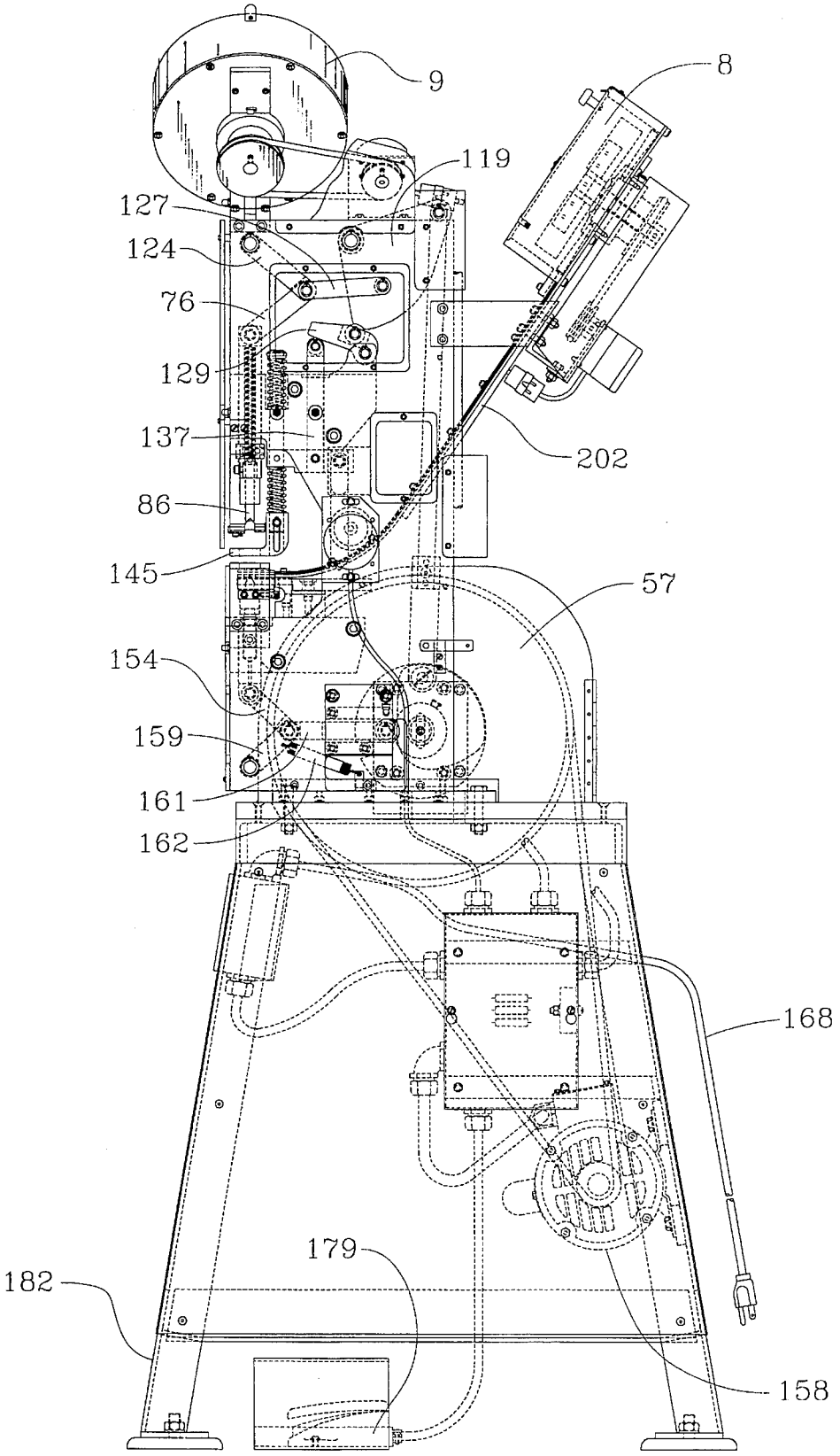
FIG. 1*a* is a right side view of the grommeting machine of the present invention.
Figure 1B:
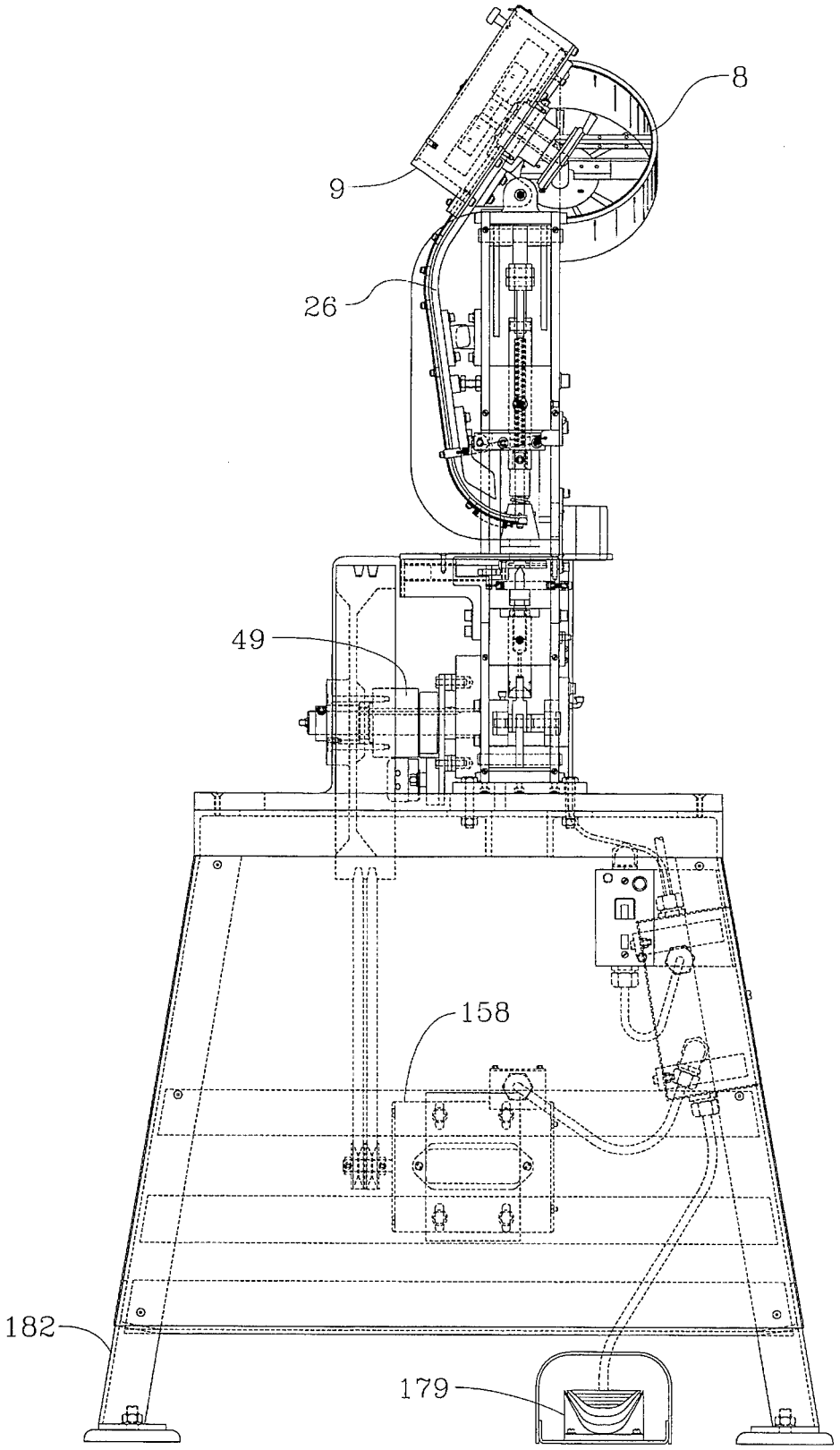
FIG. 1*b* is a front view of the grommeting machine.
Figure 1C:
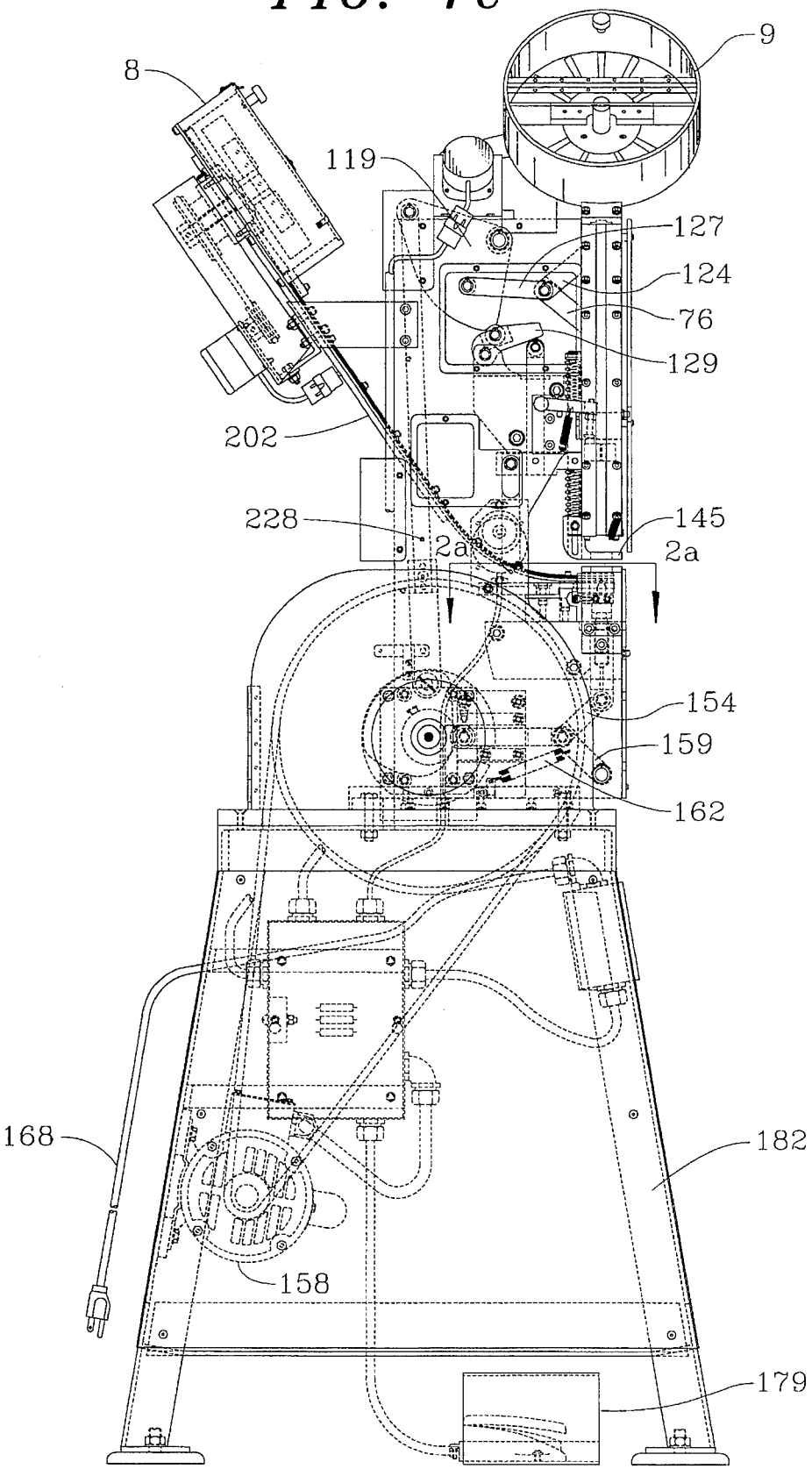
FIG. 1*c* is a left side view of the grommeting machine.
Figure 1D:
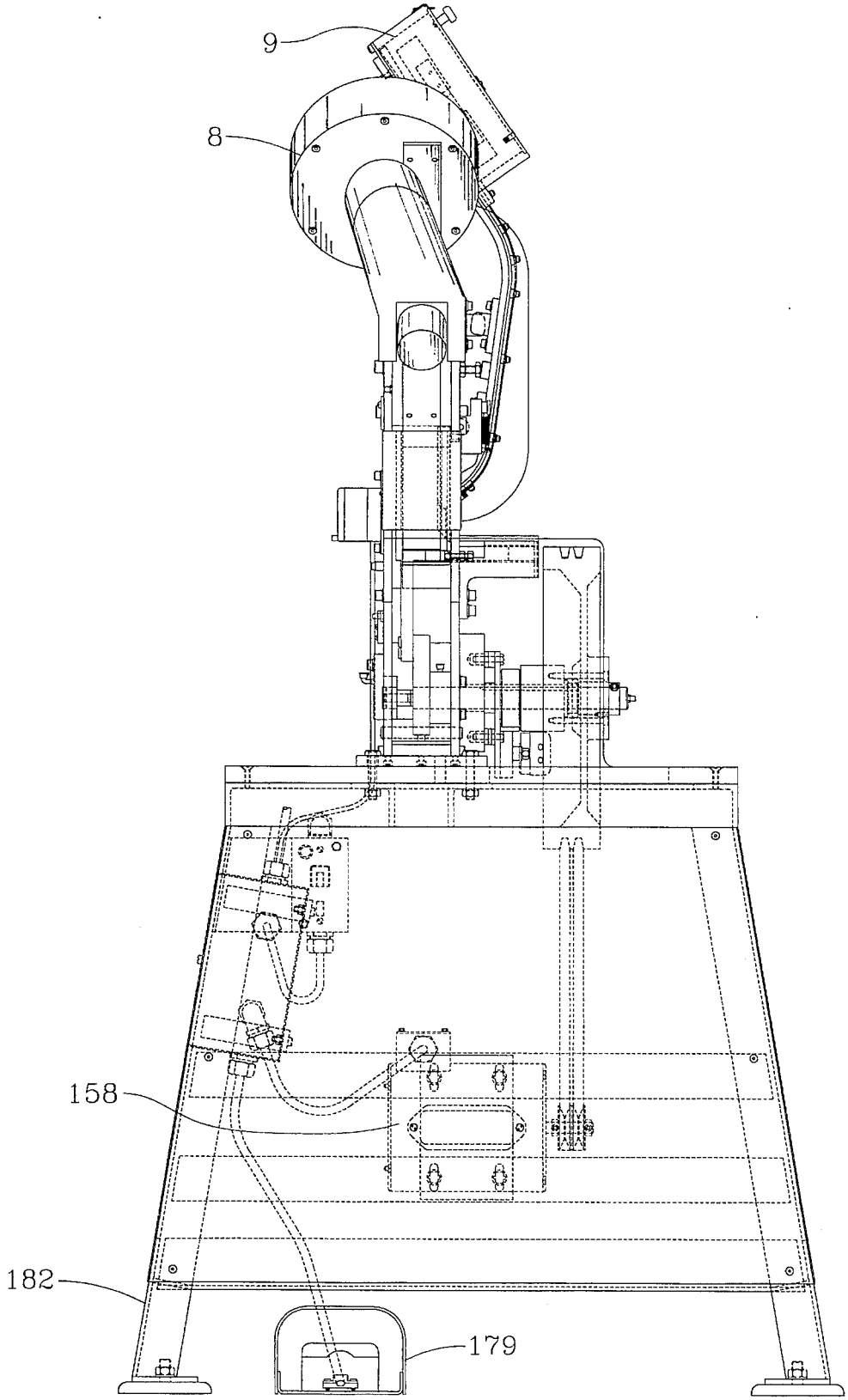
FIG. 1*d* is a rear view of the grommeting machine.

Referring now to the drawings, FIGS. 1*a*–1*d* are right, front, left and rear views, respectively, of the grommeting machine of the instant invention.

The machine generally comprises a base or stand 182, electric power means such as an electric motor 158 connected to the machine by a power cord 168, a foot pedal or switch 179 for energizing the motor 158, a flywheel 57 and clutch mechanism 49, and a grommet and washer insertion and piercing mechanism as described in more detail below. The power means may be replaced by a mechanical linkage (not shown) so the machine can be operated mechanically using the foot pedal without requiring electrical power.

Figure 2A:
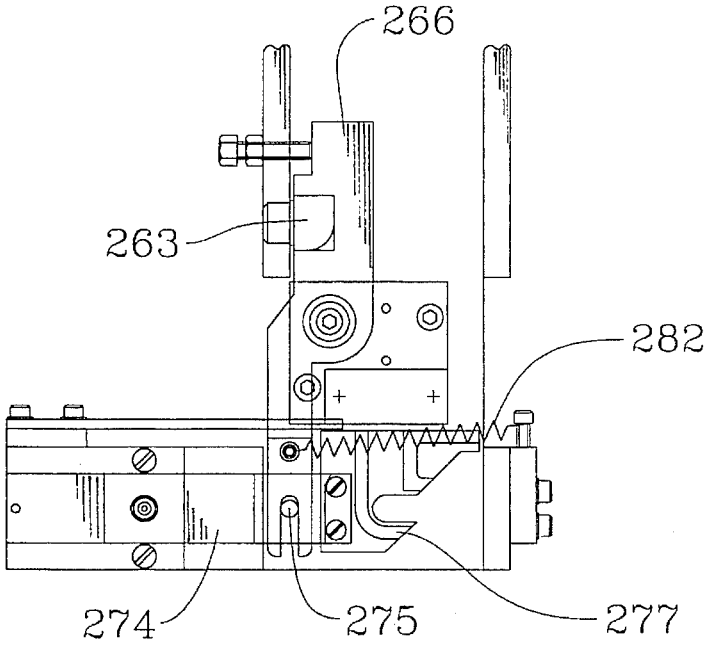
FIG. 2*a* is a plan view of the washer roadway slide in a washer delivery position.
Figure 2B:
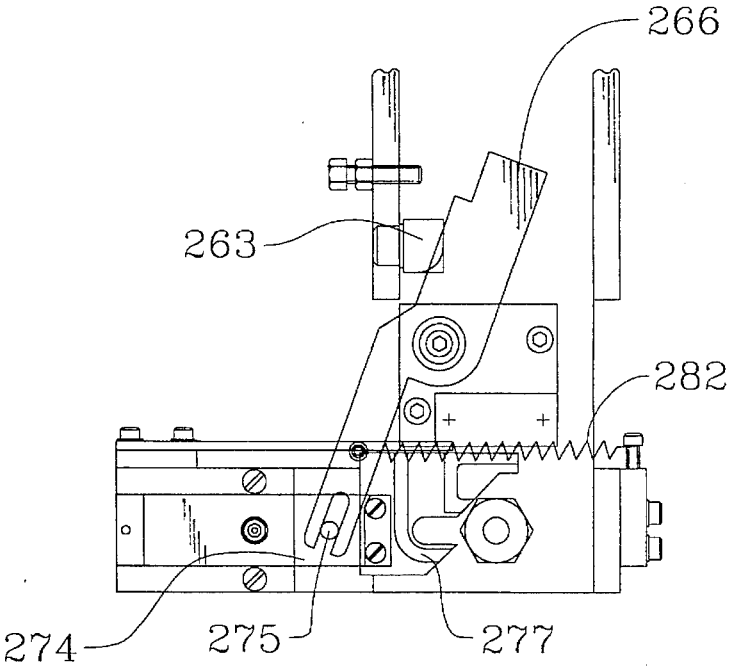
FIG. 2*b* is a plan view of the washer roadway slide in a retracted position.

The grommet/washer insertion and piercing mechanism includes a washer supply roadway 202, as shown in FIG. 1*a*. The upper portion of the washer roadway is fixed, and the lower portion of the washer roadway includes a front roadway piece 277, a slide 274 connected to the front roadway piece 277, and a pin 275 protruding from the slide 274 (see FIGS. 2*a* and 2*b*). Washers 100 are supplied to the roadway via a box 8 at the top of the roadway. The box 8 is rotated to ensure that there is a steady supply of washers to the washer supply roadway 202. Another box 9 is used to supply grommets 200 to the grommet supply roadway 26, described in more detail below. A lever 266 is slidably connected at one end thereof to the pin 275, and the opposite end of the lever 266 is contacted by the lower, angled end of a cam rod 263 which functions as a wedge for moving the lever 266 to retract the front roadway piece 277 of the grommet supply roadway 26. The lever 266 is pivotally supported between its two ends. When the cam rod 263 is moved downward (after the washer has been inserted), the angled end of the cam rod 263 contacts the opposite end of the lever 266, causing the lever 266 to pivot so that the slide and front roadway piece at the one end of the lever are withdrawn to a retracted position (FIG. 2*b*) to allow the piercing/setting process to begin. When the cam rod 263 is lifted, a biasing spring 282 causes the front roadway piece 277 to return to a washer delivery position above the bottom set 93 (FIG. 2*a*).

Figure 3A:
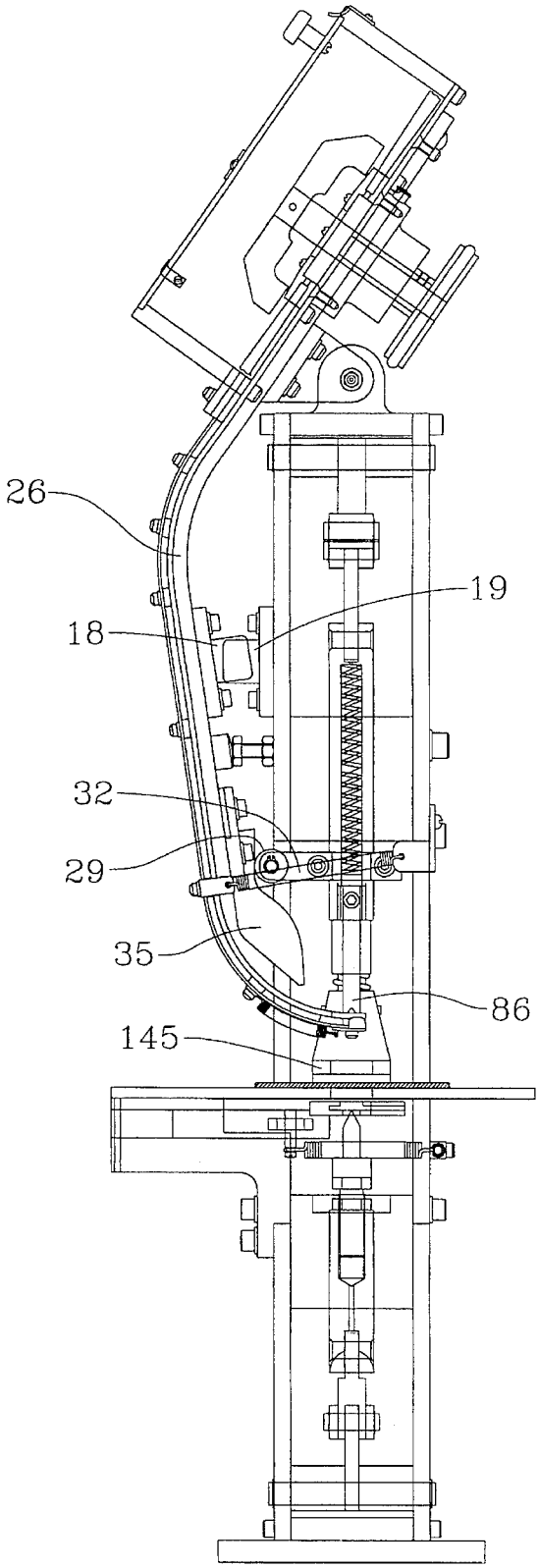
FIG. 3*a* is a front view of the grommeting machine showing the grommet roadway slide in a grommet delivery position.
Figure 3B:
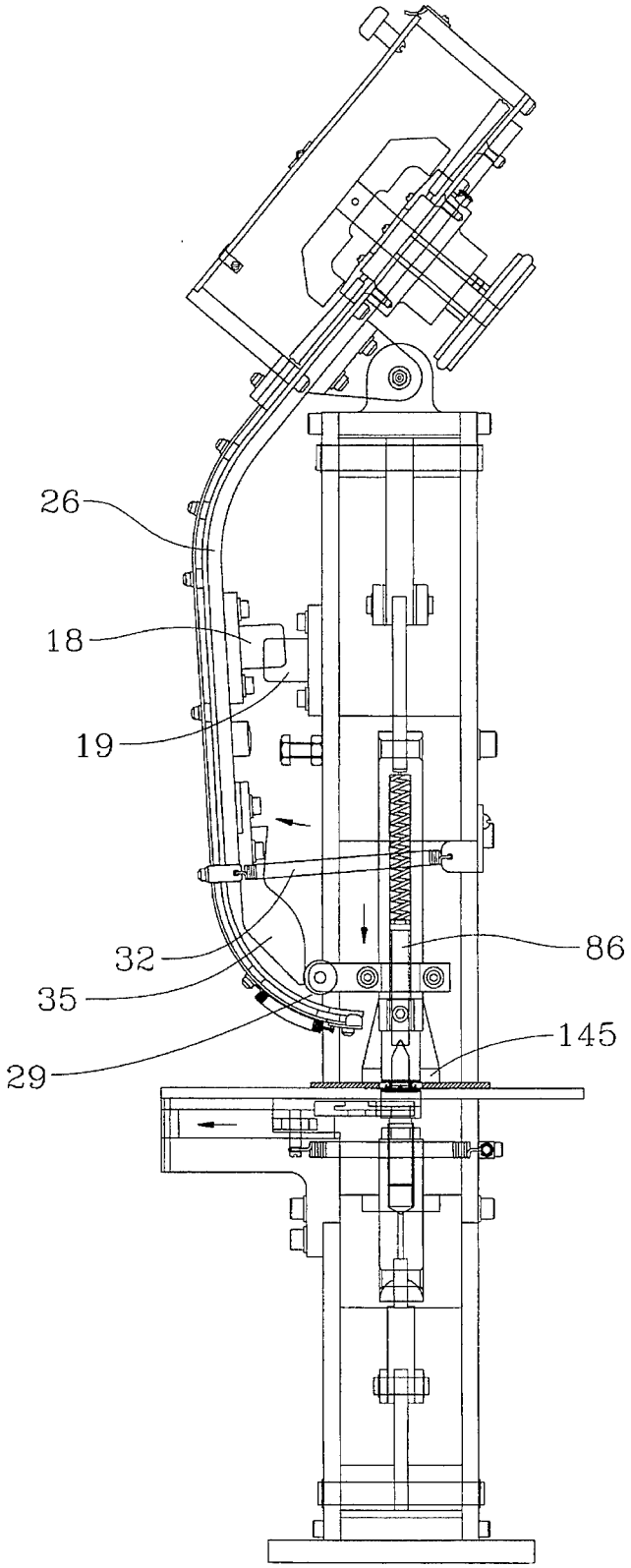
FIG. 3*b* is a front view of the grommeting machine showing the grommet roadway slide in a retracted position.

The grommet/washer insertion and piercing mechanism also includes a grommet supply roadway 26, mentioned above, and as shown in more detail in FIGS. 3*a* and 3*b*. The grommet supply roadway 26 is hingedly attached to the grommeting machine near the top of the machine, and a roadway cam 35 is fixedly secured to the lower end of the roadway 26 and operatively associated with the top set 86 (described below) for retracting the roadway 26 when the top set 86 is moved downward, as shown in FIGS. 3*a* and 3*b*. The lower end of the roadway 26 terminates adjacent to, and above, the clamper 145 (described below). When the top set 86 is withdrawn (between piercing operations), a biasing spring 32 causes the grommet supply roadway 26 to return to a grommet delivery position above the clamper 145, as shown in FIG. 3*a*.

Figure 4A:
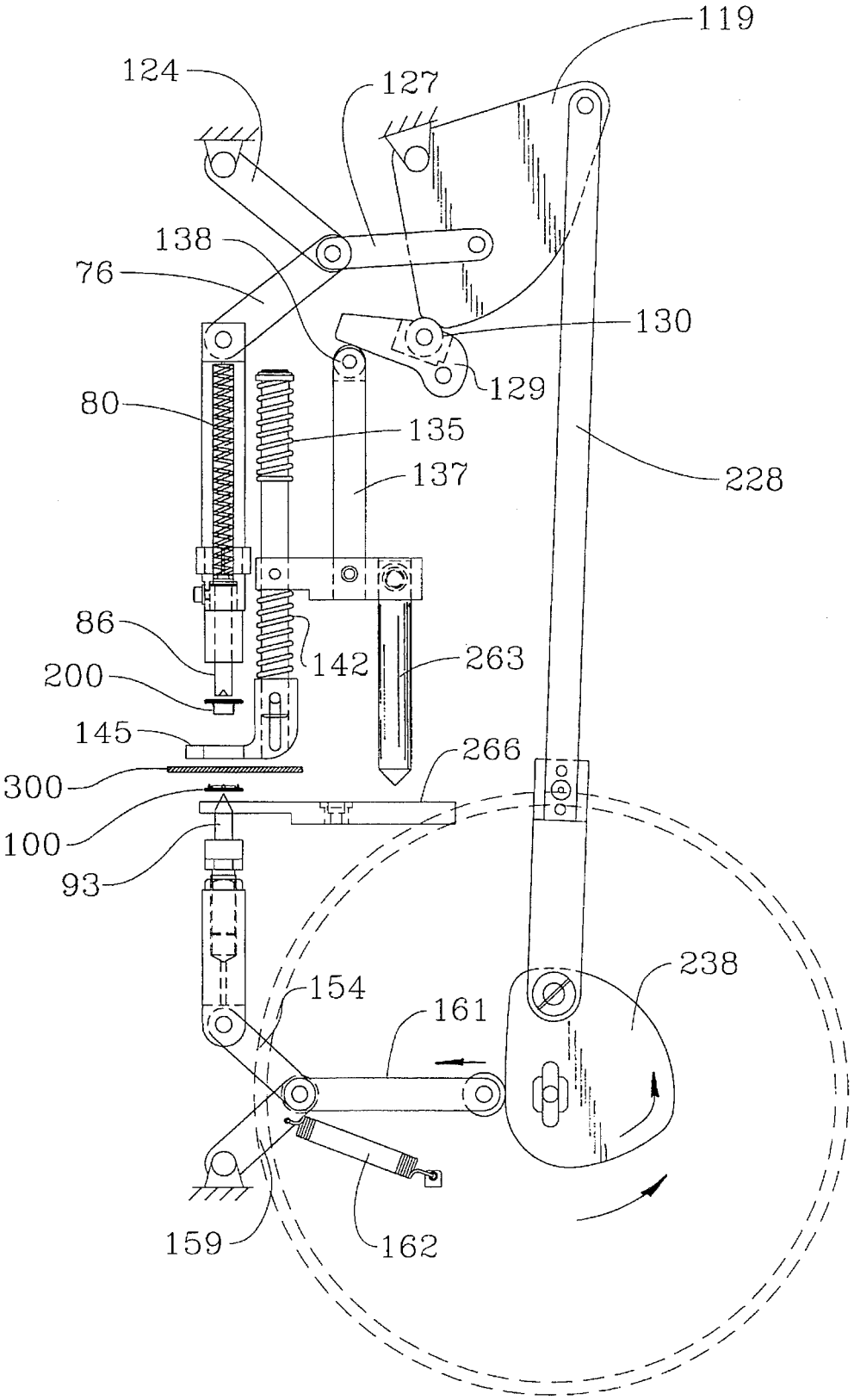
FIG. 4*a* is a right side view of the piercing/setting elements in a fully retracted position between piercing/setting operations.
Figure 4B:
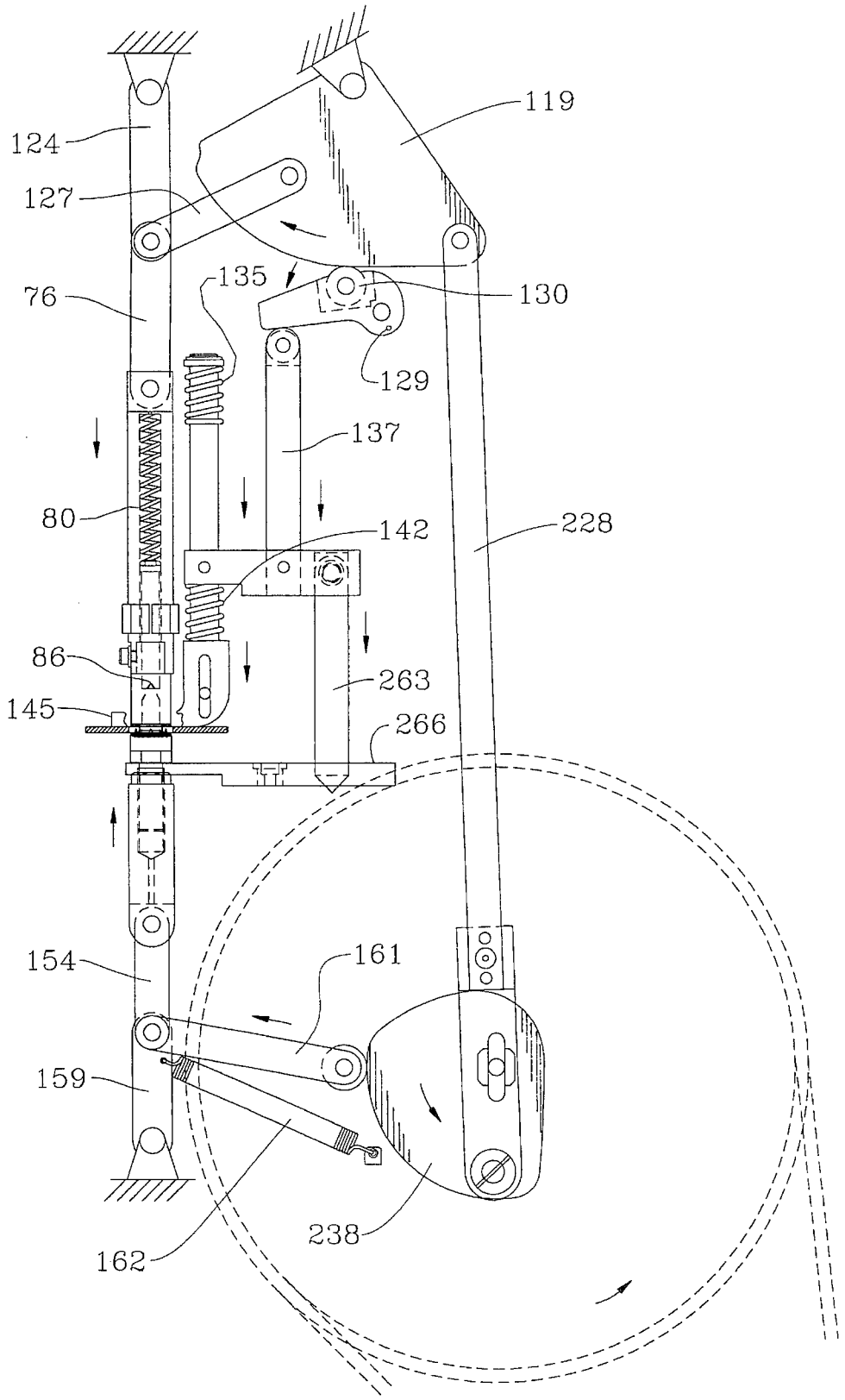
FIG. 4*b* is a right side view of the piercing/setting elements in a setting position.

FIGS. 4*a* and 4*b* are right side views of the piercing/setting elements of the invention in fully retracted, and piercing and setting positions, respectively.

The piercing/insertion elements include a first cam 238, a first linking means 228 rotatably connected to the first cam 238 at one end thereof, and a second cam 119 rotatably supported above the first cam 238 and rotatably connected to the first linking means 228 at the opposite end thereof. The top set 86, the clamper 145 and the cam rod 263 are each connected with the second cam 119, and the cam rod 263 has an angled lower end which when moved vertically downward acts as a wedge in pivoting the lever 266 for retracting the front roadway piece 277 of the washer supply roadway 202. As described above, the roller 29 protrudes from the top set 86 and contacts the roadway cam 35 fixedly secured to the grommet supply roadway 26 for retracting the roadway after a grommet 200 has been delivered. Male and female roadway guides 18, 19, respectively, are used to stabilize the movement of the grommet supply roadway 26 as it is retracted and returned to a grommet delivery position.

A second linking means 154, 159 and 161 is connected with the first cam, and the bottom set 93 is connected with the second linking means. A first biasing spring 162 pulls the second linking means towards a lowermost (retracted) position. A second biasing spring 80 forces the top set 86 downwardly against the setting and piercing force. Third and fourth springs 135, 142 force the clamper 145 towards a clamping (extended) position.

In operation, beginning from the fully retracted position between piercing/setting operations (see FIG. 4*a*), torque is generated by the electric motor 158 such that the flywheel 57 is made to turn in a counterclockwise direction. As the flywheel 57 turns in a counterclockwise direction, the first cam 238 is also made to rotate in the counterclockwise direction, causing the first linking means 228 to move downward and to the left. The second cam 119 is rotatably connected to the first linking means 228 so that it also moves downward and to the left. The top set 86, clamper 145 and cam rod 263 are operatively associated with the second cam 119, as described in detail below. The cam rod 263 is moved downward, causing the washer supply roadway 202 to retract, as described above (see FIG. 2*b*). The clamper 145 is also moved downward to support the material 300 as it is pierced by the bottom set 93, as shown in FIG. 4*b*. After the roller 29 contacts the roadway cam 35 to retract the grommet supply roadway 26, or simultaneously therewith (see FIG. 3*b* showing the grommet supply roadway 26 in a retracted position), the top set 86 is moved downward to complete the insertion and setting process.

As shown in FIGS. 4*a*–4*b*, a bracket or lever 129 is pivotally supported between a common link or plunger 137 (vertically extending) which activates the up and down movement of the cam rod 263 and the clamper 145, and the second cam 119. A roller 130 is rotatably supported by the bracket 129 to follow the movement of the second cam 119, and the plunger 137 has a roller 138 at its uppermost end which follows the movement of the tip end of the bracket 129. When the second cam 119 moves downward, the bracket 129 also moves downward, and the cam rod 263 and the clamper 145 follow.

The top set 86 is moved independently of the cam rod 263 and the clamper 145, as shown in FIGS. 4*a*–4*b*. Three links 76, 124 and 127 are used to control the movement of the top set 86. A first link 127 is pivotally connected at one end thereof to the second cam 119. The opposite end of the first link 127 is pivotally connected to an upper link 124 and a lower link 76. The upper link 124 is pivotally connected at an opposite end to a fixed point on the machine, and the opposite end of the lower link 76 is pivotally connected to the top of the top set 86.

The bottom set 93 is moved upwardly against the force of the top set 86. Two links 154, 159 and a roller bracket 161 connect the bottom set 93 with the first cam 238, as shown in FIGS. 4*a*–4*b*. The connection is similar to the one described above for controlling the movement of the top set 86, except that a roller bracket 161 replaces the pivotally connected link 127. The roller bracket 161 rides against the surface of the first cam 238. The opposite end of the roller bracket is pivotally connected to the upper link 154 and the lower link 159. The lower link 159 is pivotally connected at an opposite end to a fixed point on the machine, and the opposite end of the upper link 154 is pivotally connected to the bottom of the bottom set 93. Thus, when the first cam 238 is rotated counterclockwise from the starting position in FIG. 4*a*, the roller bracket 161 is moved to the left, causing the upper and lower links 154, 159, respectively, to become vertically aligned so that the bottom set 93 is raised against the force of the top set 86. In this manner, the material 300 is pierced, and the grommet or eyelet and washer are set into the material.

In the construction described above, all of the parts of the grommeting machine work together to achieve a simple and efficient insertion and piercing apparatus. Since the grommet supply roadway and only the slidably supported lower portion of the washer supply roadway are retracted, the machine does not vibrate excessive and requires less force input resulting in a simpler and more efficient grommeting insertion and setting apparatus.

The instant invention has been shown and described herein in what are considered to be the most practical and preferred embodiments. It is recognized, however, that departures may be made therefrom within the spirit and scope of the invention and that obvious modifications will occur to a person skilled in the art.

What I claim is:

1. An automatic grommeting machine comprising:

a frame means;

a first cam;

first linking means rotatably connected to said first cam at a first end of said first linking means;

a second cam rotatably supported above said first cam, said second cam being rotatably connected to said first linking means at an end of said first linking means opposite from said first end;

a top set, a clamper and a cam rod, each being movable by rotation of said second cam, said cam rod having an angled lower end;

second linking means engaging a surface of said first cam;

a bottom set connected to said second linking means;

a grommet supply roadway having an upper portion hingedly attached to said frame means and a lower end terminating adjacent to, and above, said clamper;

a roadway cam fixedly secured proximal said lower end and in engagement with said top set for retracting said lower end when said top set is moved downward;

a washer supply roadway, one end of said washer supply roadway terminating adjacent to, and slightly above, said bottom set, said washer supply roadway comprising a fixed upper portion and a slidably supported lower portion; and a lever connecting said cam rod and said slidably supported lower portion so that said slidably supported lower portion is retracted when said angled end of said cam rod is moved downward against an edge of one end of said lever opposite said slidably supported lower portion.

2. An automatic grommeting machine as recited in claim 1, wherein said slidably supported lower portion comprises:

a front roadway piece;

a slide connected to said front roadway piece; and a pin protruding from said slide.

3. An automatic grommeting machine as recited in claim 2, wherein an end of said lever opposite said one end is rotatably connected to said pin for relative rotational movement between said lever and said slidably supported lower portion.

4. An automatic grommeting machine as recited in claim 3, further comprising a spring for biasing said front roadway piece towards a washer delivery position.

5. An automatic grommeting machine as recited in claim 1, further comprising:

a bracket rotatably supported about one end;

a roller rotatably supported by said bracket and engaging said surface of said second cam;

a plunger having an end with a roller, said roller engaging an end of said bracket opposite said one end;

a second bracket connected to said plunger, said cam rod being fixedly secured to one end of said second bracket and extending substantially vertically downward therefrom.

6. An automatic grommeting machine as recited in claim 5, wherein said clamper comprises:

a clamper foot plunger connected to said second bracket to extend substantially vertically downward therefrom;

a clamper foot slidably connected to a lower end of said clamper foot plunger; and a clamper foot lower spring biasing said clamper foot in a lowermost position.

7. An automatic grommeting machine as recited in claim 1, wherein said top set comprises:

a first link having a first end and a second end, said first link being rotatably connected at a first end thereof to said second cam;

a second link having a first end and a second end, said second link being rotatably connected at a first end thereof to said second end of said first link, said second link being rotatably connected at said second end to a fixed, stationary point on the grommeting machine;

a plunger having a first end and a second end, said plunger being rotatably connected at said first end thereof to said second end of said first link; and a spindle rotatably connected at a top end thereof to, and extending substantially vertically downward from, said second end of said plunger.

8. An automatic grommeting machine as recited in claim 7, wherein said spindle comprises:

a spindle spring; and a top set spindle.

9. An automatic grommeting machine as recited in claim 1, wherein said second linking means comprises:

a roller bracket having a first end and a second end;

at least one roller rotatably connected to said roller bracket at said first end for following said first cam;

a first link having a first end and a second end, said first link being rotatably connected at a first end thereof to said second end of said roller bracket, said first link being rotatably connected at said second end thereof to a fixed, stationary point on the grommeting machine;

a second link having a first end and a second end, said second link being rotatably connected at said first end thereof to said second end of said roller bracket; and a bottom plunger rotatably connected at a bottom end thereof to, and extending substantially vertically upward from, said second end of said second link.

10. An automatic grommeting machine as recited in claim 1, wherein said bottom set comprises:

a pointed, rigid member.

11. An automatic grommeting machine as recited in claim 1, wherein said angled end of said cam rod is 45°.

12. An automatic grommeting machine as recited in claim 1, wherein said cam rod has a pointed lower end.

* * * * *